US011246376B2

(12) United States Patent
Lubart

(10) Patent No.: US 11,246,376 B2
(45) Date of Patent: Feb. 15, 2022

(54) FOOTWEAR WITH SLIP RESISTANT SOLE

(71) Applicant: Shoes For Crews, LLC, Boca Raton, FL (US)

(72) Inventor: Randy N Lubart, Palm Beach Gardens, FL (US)

(73) Assignee: SHOES FOR CREWS, LLC, Boca Raton, FL (US)

( * ) Notice: Subject to any disclaimer, the term of this patent is extended or adjusted under 35 U.S.C. 154(b) by 0 days.

(21) Appl. No.: 16/110,755

(22) Filed: Aug. 23, 2018

(65) Prior Publication Data

US 2020/0060386 A1 Feb. 27, 2020

(51) Int. Cl.

| | |
|---|---|
| ***A43B 13/22*** | (2006.01) |
| ***A43C 15/16*** | (2006.01) |
| ***A43B 5/08*** | (2006.01) |
| *A43B 23/07* | (2006.01) |
| *A43B 23/08* | (2006.01) |
| *A43B 23/02* | (2006.01) |

(52) U.S. Cl.

CPC ..... *A43B 13/22* (2013.01); *A43B 5/08* (2013.01); *A43B 13/223* (2013.01); *A43C 15/162* (2013.01); *A43B 23/02* (2013.01); *A43B 23/07* (2013.01); *A43B 23/082* (2013.01)

(58) Field of Classification Search

CPC ..... A43B 5/08; A43B 13/22; A43B 13/223; A43C 15/00; A43C 15/02; A43C 15/04; A43C 15/16; A43C 15/162

USPC ..... 36/59 R, 59 C, 59 A, 8.1, 67 R, 67 A

See application file for complete search history.

(56) References Cited

U.S. PATENT DOCUMENTS

| | | | | |
|---|---|---|---|---|
| 3,717,943 | A | 2/1973 | Orndorff, Jr. | |
| 4,202,116 | A | 5/1980 | Dassler | |
| 4,274,211 | A | 6/1981 | Funck | |
| 4,455,765 | A | 6/1984 | Sjosward | |
| 5,293,701 | A * | 3/1994 | Sullivan | A43C 15/164 36/114 |
| 7,047,672 | B2 | 5/2006 | Hoffer et al. | |
| 7,703,221 | B2 | 4/2010 | Richards et al. | |
| 8,096,012 | B2 * | 1/2012 | Lubart | A47L 23/24 15/143.1 |
| 8,322,050 | B2 | 12/2012 | Lubart | |
| 9,491,985 | B2 * | 11/2016 | Lubart | A43B 13/22 |
| 2002/0078598 | A1 * | 6/2002 | Bell | A43B 13/223 36/59 R |
| 2005/0257402 | A1 * | 11/2005 | Kobayashi | A43B 5/10 36/59 R |

(Continued)

FOREIGN PATENT DOCUMENTS

| | | |
|---|---|---|
| JP | 2010022719 | 2/2010 |
| JP | 2012504480 | 2/2012 |

(Continued)

*Primary Examiner* — Marie D Bays

(74) *Attorney, Agent, or Firm* — McHale & Slavin, P.A.

(57) ABSTRACT

The present invention involves footwear that utilizes tread members having generally rectangular arrays of lugs and protuberances on the lugs. Grooves separate the lugs and provide flow paths from the interior area of a tread member to the exterior. Sipes are positioned between the protuberances and form flow paths from the interior area of the lugs to the grooves. The tread members are positioned at least at the forefoot portion and heel portion of the outsole.

6 Claims, 6 Drawing Sheets

(56) References Cited

U.S. PATENT DOCUMENTS

| | | | | |
|---|---|---|---|---|
| 2006/0059716 | A1* | 3/2006 | Yamashita | A43B 13/14 36/59 R |
| 2009/0188132 | A1 | 7/2009 | Fujikawa et al. | |
| 2009/0293314 | A1* | 12/2009 | Dekovic | A43B 13/141 36/103 |
| 2009/0307932 | A1* | 12/2009 | Kirby | A43C 15/00 36/134 |
| 2011/0017373 | A1* | 1/2011 | Lee | B60C 11/11 152/209.18 |
| 2012/0110876 | A1* | 5/2012 | Lubart | A43B 13/223 36/59 C |
| 2013/0042504 | A1* | 2/2013 | Yang | A43B 13/223 36/59 C |
| 2015/0128455 | A1* | 5/2015 | Lubart | A43B 13/22 36/25 R |
| 2016/0174659 | A1* | 6/2016 | Lubart | A43B 13/223 36/59 C |

FOREIGN PATENT DOCUMENTS

| | | |
|---|---|---|
| KR | 1020160018082 | 2/2016 |
| KR | 101687404 | 12/2016 |

* cited by examiner

FOOTWEAR WITH SLIP RESISTANT SOLE

RELATED APPLICATIONS

This application is related to U.S. Non-Provisional patent application Ser. No. 14/080,123, filed Nov. 14, 2013, entitled "OUTSOLE TREAD PATTERN", which is now U.S. Pat. No. 9,491,985, which issued Nov. 15, 2016; the contents of which are incorporated herein by reference.

FIELD OF THE INVENTION

The present invention relates generally to footwear, and in particular to a slip resistant outsole construction for use in footwear such as boots, shoes, sandals or the like.

BACKGROUND OF THE INVENTION

A shoe is an item of footwear intended to protect and comfort the human foot while doing various activities. Shoes are also used as an item of decoration. The design of shoes has varied enormously through time and from culture to culture, with appearance originally being tied to function. Additionally, fashion has often dictated many design elements, such as whether shoes have very high heels or wide flat ones. Contemporary footwear varies widely in style, complexity and cost. Basic sandals may consist of only a thin sole and simple strap. High fashion shoes may be made of very expensive materials in complex construction and sell for thousands of dollars a pair. Other shoes are for very specific purposes, such as boots or shoes specially designed for workers or heavy outdoor use.

A boot is a special type of footwear which covers the foot and the ankle and can extend partially up the leg, sometimes as far as the knee or even the hip. Most boots have a heel that is clearly distinguishable from the rest of the sole, even if the two are made of one piece. They are typically made of leather or rubber like material, although they may be made from a variety of different materials. Boots are worn for their functionality for protecting the feet and legs from water, snow, mud or hazards, providing additional ankle support for strenuous activities or providing traction to a particular type of surface, as well as for reasons of style and fashion. Boots are designed to withstand heavy wear to protect the wearer. They are generally made from sturdy leather uppers and non-leather outsoles. They may be used for uniforms of the police or military, as well as for protection in industrial settings such as mining and construction. Protective features may include steel-tipped toes, soles or ankle guards, and nonslip outsoles for interaction with slick surfaces.

Traction or grip to a ground or floor surface is beneficial for a work shoe or boot to provide for worker safety. Workers often perform their duties on a greasy, wet or damp surface. For example, many industries or companies utilize floors which are covered by materials which resist the penetration of fluids or other substances. These flooring materials are utilized so that any substance inadvertently spilled on the floor can be quickly and completely removed from the floor. One of the drawbacks to these types of floorings is that, whenever water or other liquids or semi liquids are spilled on these floors, they become very slippery. Examples of this are the floorings utilized in restaurants, hotels, hospitals and other institutions. Thus, what is needed is a footwear outsole that can be utilized with a wide variety of footwear types which will provide protection from slips and falls whenever wet, or grease covered floors are encountered.

Traction on a floor is influenced by many factors and may or may not follow rules; see for example, *Measuring the Influences of Footwear Shape and Area on the Coefficient of Friction by English XL* in *Advances in Physical Ergonomics and Human Factors,* 2016, by Ching-Chung Chen et al. The viscosity of the coating on the floor, flooring roughness and the squeeze film factor are important factors affecting friction. However, such factors are out of the control of a shoe manufacturer.

DESCRIPTION OF THE PRIOR ART

Many different shoe soles have been proposed to prevent an individual from slipping. In U.S. Pat. No. 3,717,943, the sole of a boot or overshoe is made from rubber and includes fins and grooves. The fins cooperate with the grooves to trap air within the grooves. The air facilitates the self cleaning feature of the boots which removes mud and other substances from the soles of the boots.

U.S. Pat. No. 4,202,116 discloses a tread for a sport shoe which includes a sole having projections extending outwardly from a tread surface. The tread includes a one-piece, thin walled, metal part with at least two separate, dimensionally reinforced surface sections bearing the integrally molded projections. The reinforced surface includes a plurality of embossed, smooth-surfaced and beveled projections. The metal part is fixedly secured to an inner surface of the shoe sole by either a thin wire grid embedded in the synthetic resin sole or uniformly distributed perforations.

U.S. Pat. No. 4,274,211 discloses a shoe sole made of flexible rubber material with a non-slip profile. The sole includes a plurality of variously sized projections or layered elements. The elements include surfaces which are made from materials that are slip resistant. In addition to being slip resistant, the structure and spacing of the projections prevents the accumulation of mud and other debris on the soles of the shoes.

U.S. Pat. No. 4,455,765 discloses a sport shoe sole that possesses a high coefficient of friction along certain portions of the outsole, while other portions of the outsole are formed of a compressible and resilient material that is harder than the material of the rest of the outsole.

U.S. Pat. No. 7,047,672 discloses a shoe sole which is designed to be used on a sand surface. The outsole is made from a compressed material having an upper surface and a lower surface. A peripheral lip projects downwardly from the lower surface of the outsole. A plurality of fins also project downwardly from the lower surface. This type of construction enables efficient propulsion in sandy environments.

U.S. Published Patent Application No. 2009/0188132 discloses a slip resistant shoe outsole which includes a plurality of ground contacting projections. The ground contacting projections are V-shaped and are spaced from one another by a predetermined distance in a longitudinal direction of the outsole of the shoe. The V-shaped projections also include reinforcements at their base. The projections are made from an elastomeric polymer with a specific JIS-A hardness. This material increases the shoe's ability to resist slipping, and the shape of the projections increases their resistance to avoid bending and deformation.

U.S. Pat. No. 7,703,221 discloses an outsole assembly for a shoe which includes a flexible base having an underside surface which includes a forward region, a rearward region, and an intermediate region therebetween. The outsole includes a plurality of individual outsole elements on the underside thereof. Each element includes a body portion and a connecting section which is operatively secured to the underside surface of the flexible base. The outsole elements are arranged on the underside surface of the flexible base such that adjacent outsole elements have overlapping sections.

U.S. Pat. No. 8,322,050, to the present Assignee, discloses a slip resistant outsole that includes chevron shaped treads for channeling water and grease away from the ground engaging treads.

U.S. Publication 2015/0128455, published May 14, 2015, and assigned to the current Assignee, discloses a slip resistant outsole that utilizes a squeegee effect and flow channels to improve traction on wet flooring.

However, none of the prior art teach or suggest a shoe outsole that is suitable for use on a wide variety of footwear to work on wet or grease covered surfaces utilizing lugs with sipes.

SUMMARY OF THE INVENTION

The present invention provides an outsole for footwear, and more particularly an outsole particularly suited for a work type shoe. The ground engaging surface of the outsole includes at least one tread member thereon. The tread member includes a plurality of lugs separated by grooves. The lugs have a pedestal with a plurality of protuberances separated by sipes in flow communication with at least the immediately adjacent grooves. The protuberances and lugs are arranged in generally rectangular arrays. The material from which the protuberances are formed increases the outsole's ability to resist slipping on floor surfaces when covered with oil, water, soap, etc. The shape and pattern of the protuberances enable them to control flexing and engagement to the floor surface. This increases the outsole's ability to resist slipping. The sipes and grooves are configured for flow communications to allow liquids to move outwardly of the protuberances and the tread members.

Accordingly, it is a primary objective of the instant invention to provide footwear with a high traction outsole.

It is a further objective of the instant invention to provide such an outsole with a unique tread design having a plurality of lugs that are separated by grooves.

It is yet another objective of the instant invention wherein the lugs are arranged in rows and columns in a generally rectangular array.

It is a still further objective of the invention wherein the grooves form flow paths from interior portions of the outsole to the exterior of the outsole.

Other objects and advantages of this invention will become apparent from the following description taken in conjunction with any accompanying drawings wherein are set forth, by way of illustration and example, certain embodiments of this invention. Any drawings contained herein constitute a part of this specification and include exemplary embodiments of the present invention and illustrate various objects and features thereof.

DETAILED DESCRIPTION OF THE INVENTION

Figure 1:
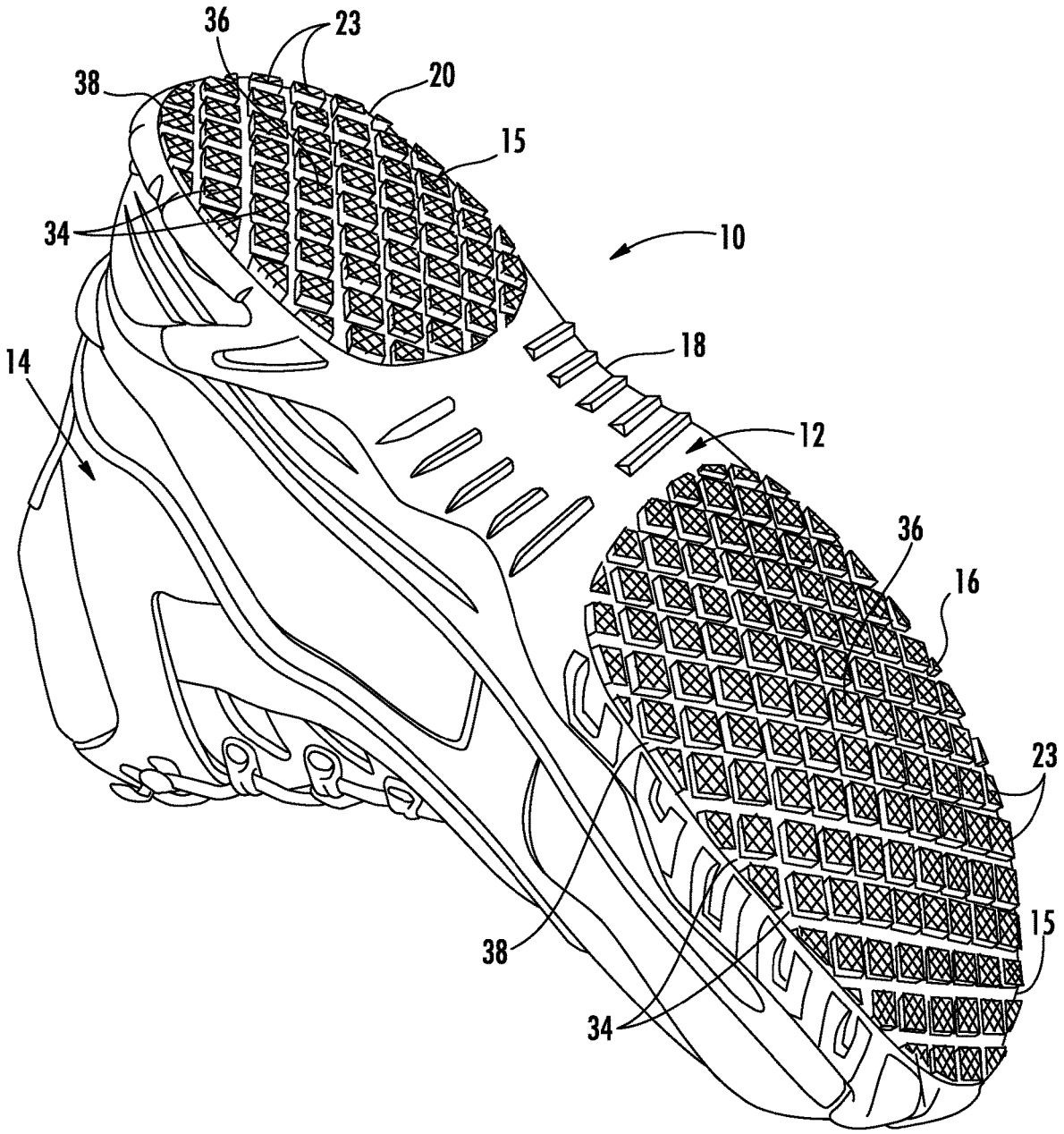
FIG. 1 is a perspective view of a shoe and its outsole as seen from the bottom of the shoe with the lugs arranged in transverse rows and longitudinal columns.

While the present invention is susceptible of embodiment in various forms, there is shown in the drawings and will hereinafter be described a presently preferred, albeit not limiting, embodiment with the understanding that the present disclosure is to be considered an exemplification of the present invention and is not intended to limit the invention to the specific embodiments illustrated.

Figure 2:
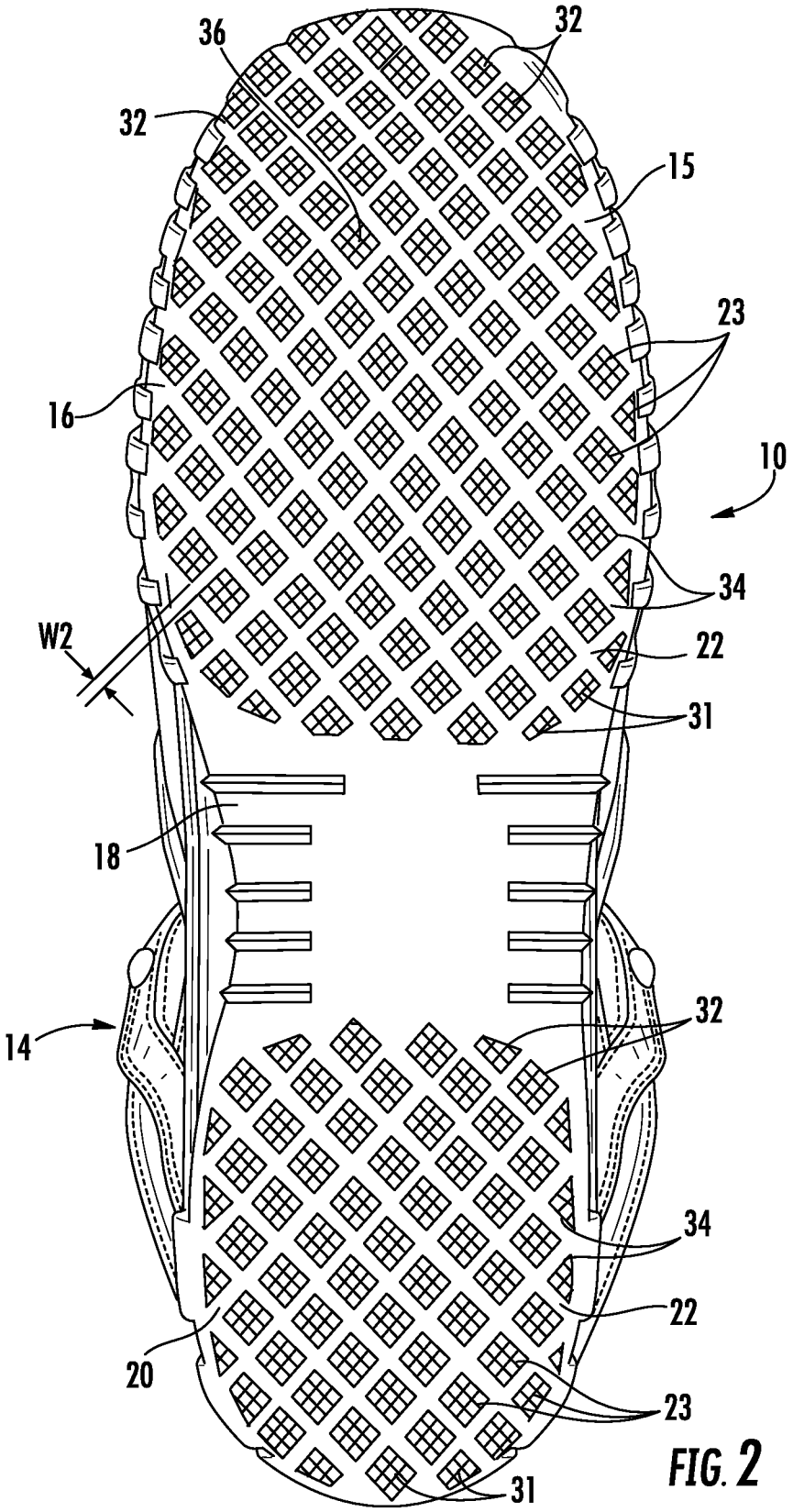
FIG. 2 is a bottom view of the shoe and its outsole as seen in FIG. 1, but with the lugs arranged in rows and columns on a bias.
Figure 3:
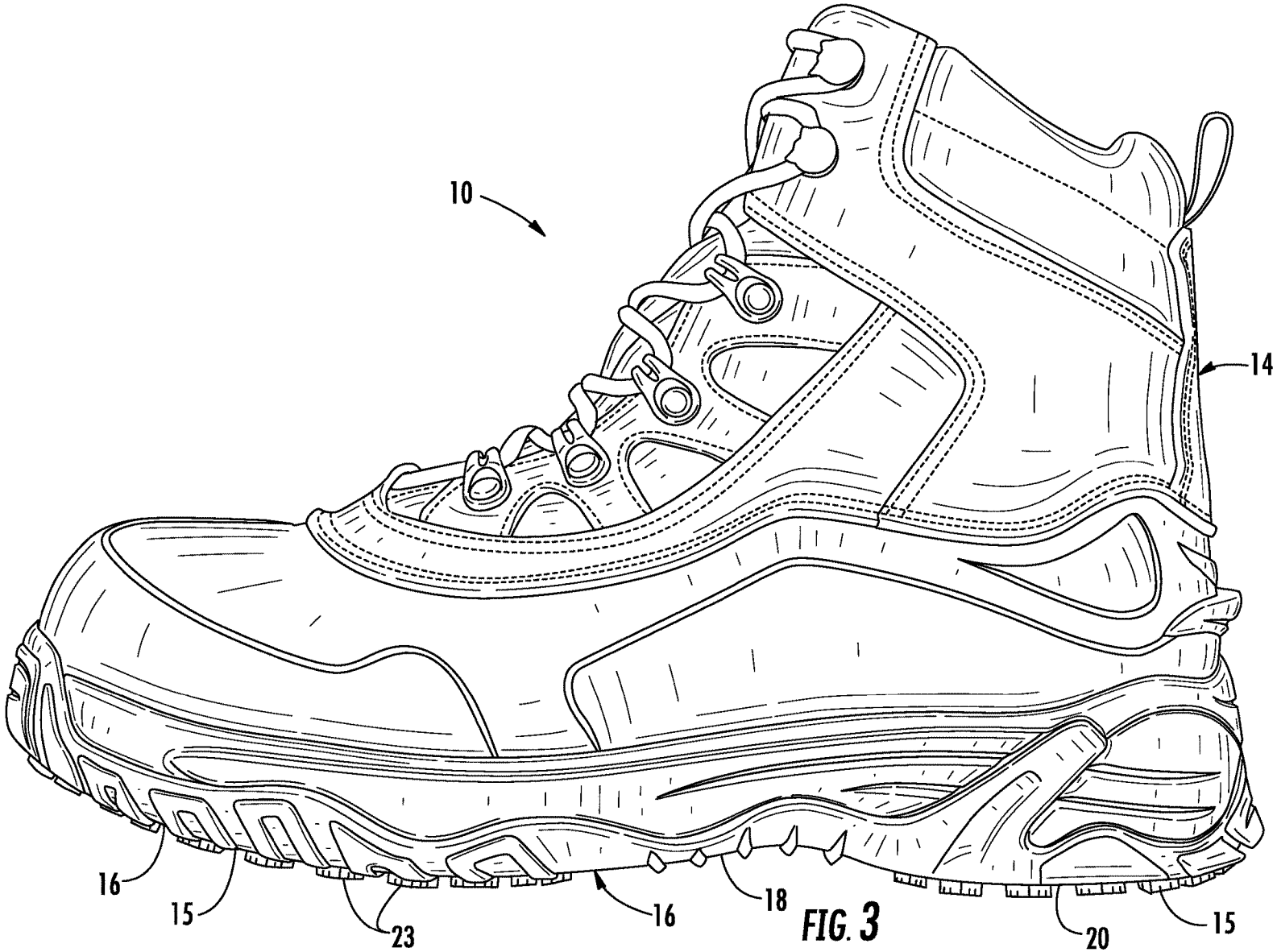
FIG. 3 is a side elevation view of the shoe of FIG. 1.

Referring to FIGS. 1-3, an article of footwear 10 having an outsole 12 for various work environments is illustrated. The footwear includes an upper 14 for securing the footwear to the user's foot and providing comfort to the user. The upper 14 may be of any design suitable for use by a person. In a particularly desired embodiment, the upper 14 is constructed in the form of a work type shoe or boot as illustrated. A shoe is differentiated from a boot by its height. A common definition of the shoe is an article of footwear that does not cover the ankle, while a boot extends above the user's ankle. Footwear, as used herein, includes shoes, boots, sandals and other forms of foot protection and comfort devices. In the illustrated embodiment, the upper 14 extends over the user's ankle to provide support and protection. In addition, the upper 14 may include insulation (not shown) and protective toe portions (not shown), like a so called "steel toe", to provide additional protection to the user. The outsole 12 is the portion of the footwear that has at least one tread portion 15 that contacts the floor surface (although not all the outsole 12 needs to contact the floor surface), and therefore provides traction to the user to reduce the risk of slips and falls. The tread portions 15 can be made by a suitable molding process. As used herein, the term "floor" means the lower surface of a room or structure on which one walks, and shall include ground and man-made outdoor surfaces on which one walks. Traction is provided by the outsole in two distinct manners. The first utilizes elements of the tread portions 15 to contact the floor working surface so that traction is provided by the surfaces of the tread portions 15. The second method of providing traction to an article of footwear is to utilize a polymeric compound that allows the outer surface of the outsole to conform, at least partially, to small floor surface imperfections which cause the polymeric compound of the outsole to create high friction with the surface, i.e., "stick" to the surface, particularly when a liquid or semi liquid, such as water, grease or oil is present. The outsole 12 is constructed from a slip resistant polymeric material having a durometer reading which allows it to conform to surface imperfections for engagement with the floor surface, i.e., traction. In a preferred embodiment, the present tread portions 15 are made from a slip resistant polymeric material with a unique tread design. The polymeric material has a hardness of about 0.49 Shore, based on tests performed on a Durometer Hardness Tester. The material also has a slip resistance rating of 0.56-0.65 when tested on a Brungraber Mark 2 Articulated Strut Slip Testing Device. A slip resistant surface is defined as a surface having a rating of 0.50 or higher when tested on the Brungraber Mark 2 Articulated Strut Slip Testing Device. The polymeric material can be of a thermoset or thermoplastic type, and can include natural or manmade elastomer (often called rubber) or plastic and blends of materials. Fillers, like carbon black, can be included in the polymeric material.

The outsole 12 includes a forefoot portion 16, a midfoot portion 18 and a heel portion 20. In a preferred embodiment, the forefoot and heel portions, 16, 20 respectively, include unique tread portions 15, while the midfoot portion 18 of the outsole 12 can include a tread portion 15 or have no tread portion. Typically, the midfoot portion 18 is configured to not contact the underlying surface during normal use. The tread portions 15 have a plurality of lugs 23 that are arranged in a predetermined pattern on a base 22 to provide traction to a user across a variety of surfaces, and are particularly suited for traction on wet or greasy (oily) surfaces. This provides a unique combination for workers such as those in the restaurant industry who may be required to work in the kitchen area. The tread portions 15 may be formed integrally with the outsole 12 or made separately and bonded to the selected portions of the outsole 12. The tread portions 15 include lugs 23 which are arranged in rows 31 and columns 32 and are separated by grooves 34 on the base 22.

Referring to FIGS. 1-3, the tread portions 15 have a similar tread pattern of lugs 23. A tread portion 15 has a plurality of lugs 23 arranged in rows 31 and columns 32. The rows 31 and columns 32 of lugs 23 are separated by grooves 34. The grooves 34 form flow paths or channels and/or liquid collection zones from the interior 36 of a tread portion 15 to its exterior 38. The rows 31 and columns 32 preferably form a rectangular array of lugs 23. The rows 31 and columns 32 can be arranged in any suitable orientation to the outsole 12 and, as shown in FIG. 2, the rows 31 and columns 32 are arranged on a bias of about 45° from the longitudinal axis of the outsole (heel to toe). The rows 31 and columns 32 can be arranged where the rows 31 are generally perpendicular to the longitudinal axis and the columns 32 are generally parallel to the longitudinal axis of the outsole 12.

Figure 4:
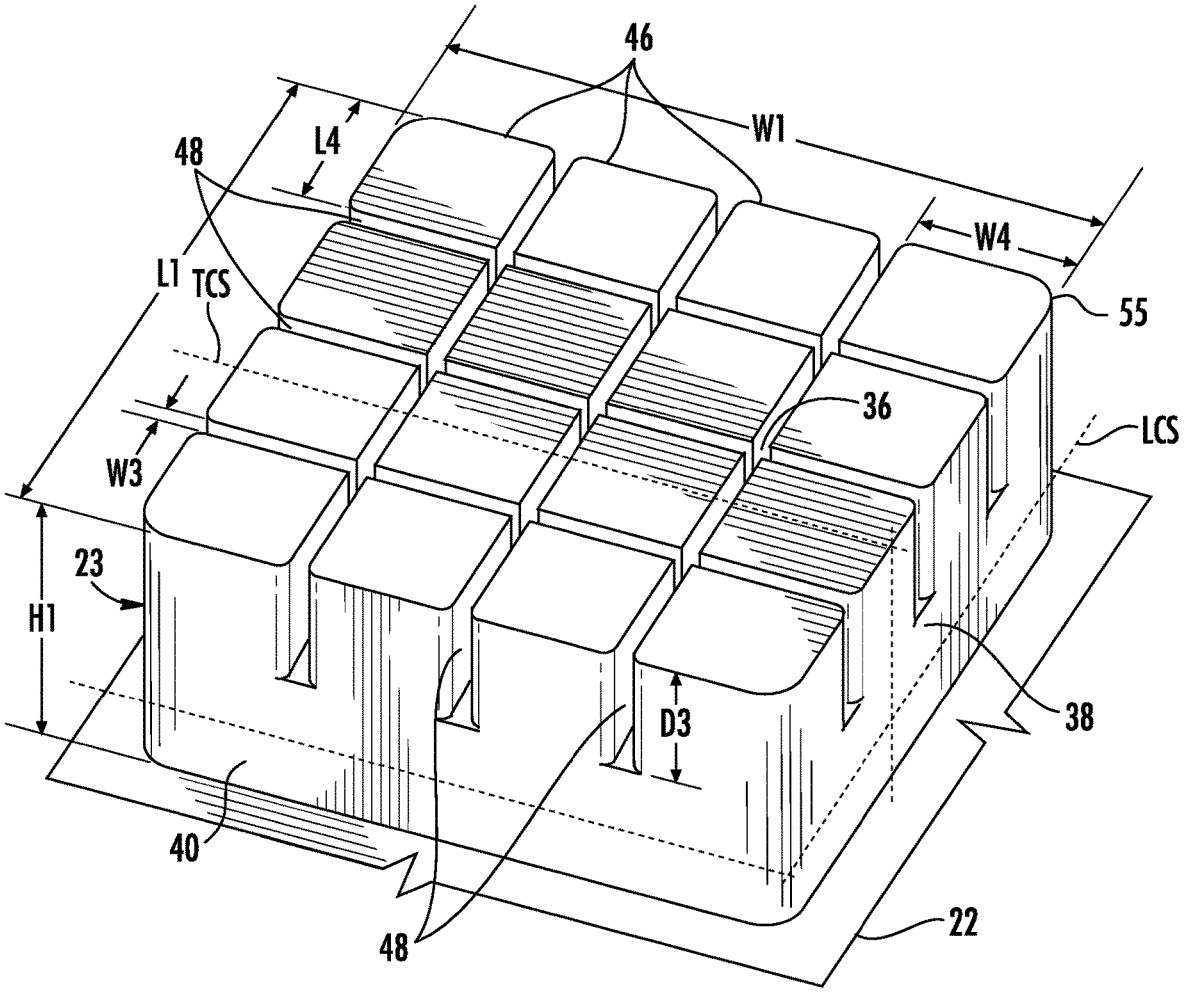
FIG. 4 is a perspective view of a first embodiment of a lug of a sole tread portion.

In a preferred embodiment, the lugs 23 are generally rectangular in plan view (lateral cross section LCS as seen in FIG. 4) and generally rectangular in transverse cross section, TCS, (vertical as the shoe would be normally positioned as seen in FIG. 4). A lug 23 includes a pedestal 40 at its proximal end extending from and preferably integral with a tread portion 15 base 22. There is a plurality of protuberances 46 projecting outwardly from the pedestal, forming a distal end of the lug 23. The protuberances 46 are preferably integral with the respective pedestal 40, and have an outer surface configured to engage a floor when the footwear 10 is in normal use. The protuberances 46 are separated from one another on a respective pedestal by sipes 48, and can move to a limited degree relative to one another under typical use conditions. The sipes 48 form flow paths from an interior area 50 of a lug 23 to its exterior 52 and communicate for flow with the grooves 34. A lug 23, and hence pedestal 40, has a width W1 in the range of between amount 0.25 inches and about 0.5 inches and a length L1 in the range of between about 0.25 inches and about 0.5 inches. The combined heights H1 of a pedestal 40 and protuberance 46, the lug 23, is in the range of between about 0.1 inches and about 0.2 inches. The width W2 of a groove 34 is in the range of between about 0.03 inches and about 0.1 inches. The width W3 of a sipe 48 is in the range of between about 0.005 inches and about 0.03 inches, and its depth D3 is in the range of between about 0.03 inches and about 0.1 inches. The sipes 48 serve two functions, providing a flow path to the grooves 34, and reducing the force needed to laterally displace the outer end portion of the protuberance 46. While not being bound by the following theory, it is believed that the sipes 48 reduce the effect of the squeeze film factor by separating the fluid film into small segments, allowing the protuberances to more easily penetrate the film and engage the floor or ground, thereby improving traction. The sipes 48 and grooves 34 provide flow paths for the film forming fluid to move into and away from the protuberances 46. In addition, the lateral size and height of the protuberances allows them to flex laterally, forward and backward, and side to side to cushion starting and stopping motion by a shoe user to also improve traction and allow them to move independently of one another. The vertical size of a protuberance 46 reduces columnar flexing, providing for a firm feeling during walking.

FIGS. 1, 2 and 4 illustrate a first embodiment of a protuberance 46 pattern. In the illustrated pattern, the protuberances 46 are of substantially equal sizes and similar shapes. The protuberances 46 are arranged in a rectangular array of rows 31 and columns 32 with at least three protuberances in each row and three protuberances in each column. The protuberances 46 all have generally rectangular transverse cross-sectional shapes parallel to the plane of the exposed end of a lug 23. It is to be noted that some of the lugs 23 may not be complete at the edges of a tread portion 15, as can be seen in FIG. 2. It is also to be noted that the corner protuberances 46 can have their outer corners 55 rounded or shaped rather than square. They are still, though, generally rectangular as described. In this embodiment, a protuberance 46 has a width W4 in the range of about 0.04 inches and about 0.08 inches, and a length L4 in the range of between about 0.04 inches and about 0.08 inches.

Figure 5:
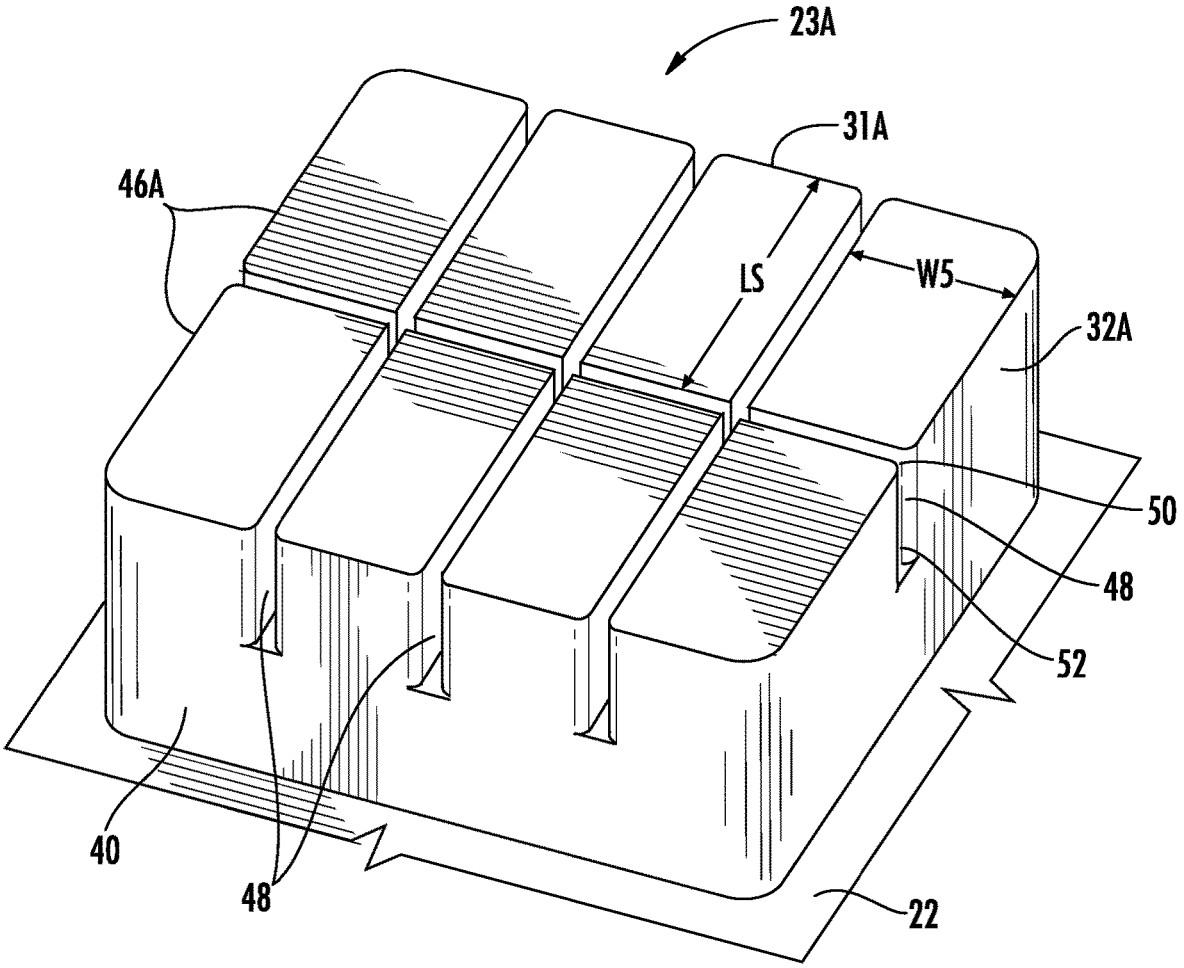
FIG. 5 is a perspective view of a second embodiment of a lug of a sole tread pattern.

FIG. 5 illustrates a second embodiment of a protuberance 46 pattern for a lug 23A. In this embodiment, the protuberances 46A are arranged in a generally rectangular array of rows 31A and columns 32A. In this case, the rows 31A and columns 32A are in 2 by 4 array. The dimensions for the sipes 48 and the pedestal 40 are as described above. In this embodiment, a protuberance 46A has width W5 (the short dimension) in the range of between about 0.06 inches and about 0.12 inches and length L5 (the long dimension) in a range of between about 0.12 inches and about 0.25 inches. As shown, the outside corners on the protuberances can be rounded if desired, but the protuberances 46A are still generally rectangular in transverse cross-section.

Figure 6:
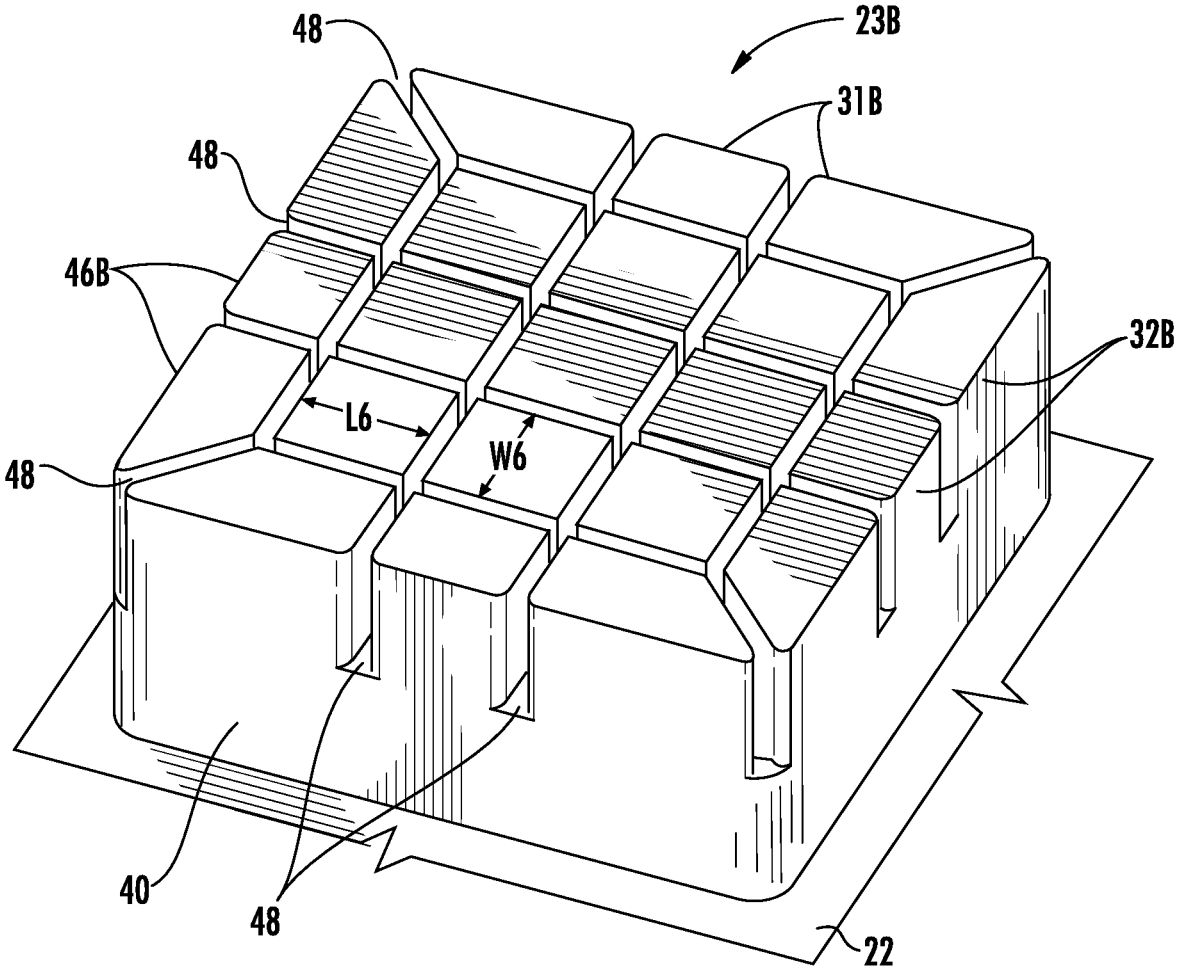
FIG. 6 is a perspective view of a third embodiment of a lug of a sole tread pattern.

FIG. 6 illustrates a third embodiment of protuberance 46 pattern. In this embodiment, the protuberances 46B are arranged in a generally rectangular array of rows 31B and columns 32B. In this case, the rows 31B and columns 32B are in a 5 by 5 array. However, the two protuberances 46B at each corner are separated by a diagonal sipe 48, connecting interior sipes 48 to the grooves 34. Also, two corner protuberances 46B replace three corner protuberances 46 as seen in FIG. 4. In this embodiment, the interior protuberances 46B have a length L6 in the range of between about 0.05 inches and about 0.1 inches, and a width W6 in the range of between about 0.05 inches and about 0.1 inches. The corner positioned protuberances 46B on the outside of the lug 23B are similarly dimensioned. As shown, outside corners on the protuberances 46B can have rounded exterior corners if desired, but the protuberances 46B are still generally rectangular in transverse cross-section.

In the illustrated embodiments, the above described lugs 23, 23A, 23B and protuberances 46, 46A, 46B are principally located to form the tread portions 15 at the forefoot portion 16 and the heel portion 20.

Among the three embodiments of lugs described above, the protuberances 46 have width in the range of between about 0.04 inch and about 0.12 inch, and length in the range of between about 0.4 inch and about 0.12 inch.

All patents and publications mentioned in this specification are indicative of the levels of those skilled in the art to which the invention pertains.

It is to be understood that while certain forms of the invention are illustrated, it is not to be limited to the specific form or arrangement herein described and shown. It will be apparent to those skilled in the art that various changes may be made without departing from the scope of the invention and the invention is not to be considered limited to what is shown and described in the specification and any drawings/figures included herein.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary, and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. A slip resistant footwear having an outsole, said footwear comprising: an upper secured to an outsole; and the outsole (12) including a forefoot portion (16), a midfoot portion (18) and a heel portion (20), at least one of said portions (16), (18), (20) including a tread portion (15) constructed from a polymeric material, said tread portion being positioned on the forefoot portion and being particularly suited for channeling liquid from a floor surface, said tread portion (15) including a plurality of lugs (23), each comprising a pedestal (40) at a proximal end thereof and at least eight protuberances (46) at a distal end thereof, said pedestals (40) being arranged in a generally rectangular array and being separated by grooves (34) between adjacent lugs (23), said protuberances (46) on a said lug (23) being arranged in a generally rectangular array and adjacent said protuberances (46) being separated by sipes (48) between adjacent said protuberances (46) on a respective said lug (23), said sipes (48) divide said lug (23) into twenty-one protuberances, said protuberances include two said protuberances at each corner of the array separated by a diagonal sipe connecting interior sipes to said grooves, a combined height of a pedestal and protuberance is in the range of between about 0.1 inches and 0.2 inches, said sipes (48) each having a depth in the range of between about 0.03 inches to about 0.1 inches and a width in the range of between about 0.005 inches and about 0.1 inches, said sipes being in flow communication with adjacent grooves (34), said grooves (34) being deeper than said sipes (48).

2. The footwear of claim 1 wherein said heel portion (20) including a said tread portion (15).

3. The footwear of claim 2 wherein said protuberances (46) being generally rectangular in transverse cross sectional shape.

4. The footwear of claim 3 wherein said pedestals (40) being generally rectangular in transverse cross sectional shape.

5. The footwear of claim 1 wherein said grooves (34) and said sipes (48) form flow paths from an interior portion (36) of said respective tread portion (15) to its exterior (38).

6. The footwear of claim 5 wherein said midfoot portion (18) being characterized by an absence of a said tread portion (15).

* * * * *